US006264310B1

(12) United States Patent
Toru et al.

(10) Patent No.: US 6,264,310 B1
(45) Date of Patent: Jul. 24, 2001

(54) MULTI-NOZZLE INK JET HEAD WITH DUMMY PIEZOELECTRIC ELEMENTS AT BOTH ENDS OF A PIEZOELECTRIC ELEMENT ARRAY FOR CONTROLLING THE FLOW OF ADHESIVE ABOUT THE PIEZOELECTRIC ELEMENT ARRAY

(75) Inventors: Takuji Toru; Nobuhiro Noto; Kenichi Kugai; Takao Matsuoka; Yoshitaka Akiyama; Kazuaki Akimoto; Nobuhiro Kurosawa; Yasuo Takano, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/031,597

(22) Filed: Feb. 27, 1998

(30) Foreign Application Priority Data

Feb. 28, 1997 (JP) ..... 9-045396

(51) Int. Cl.[7] ..... B41J 2/045
(52) U.S. Cl. ..... 347/70; 310/326
(58) Field of Search ..... 347/68, 70, 71, 347/94; 310/326, 327

(56) References Cited

U.S. PATENT DOCUMENTS 4,424,521 * 1/1984 Lewis et al. ..... 347/94 X
4,695,854 * 9/1987 Cruz-Uribe ..... 347/94 X
5,359,354 * 10/1994 Hiraishi et al. ..... 347/94 X
5,381,171 * 1/1995 Hosono et al. ..... 347/72
5,446,485 * 8/1995 Usui et al. ..... 347/94 X
5,710,584 * 1/1998 Suzuki et al. ..... 347/70
5,933,168 * 8/1999 Sakai ..... 347/70
5,983,471 * 11/1999 Osawa ..... 347/70 X

FOREIGN PATENT DOCUMENTS 54-116844 * 9/1979 (JP) ..... 310/326
56-85997 * 7/1981 (JP) ..... 310/326
58-5263 * 1/1983 (JP) ..... 347/94
58-188992 * 11/1983 (JP) ..... 310/326
62-262472 * 11/1987 (JP) ..... 310/326
4-276448 * 10/1992 (JP) ..... 347/94
5-246025 9/1993 (JP) .
6-206310 * 7/1994 (JP) ..... 347/94

* cited by examiner

*Primary Examiner*—Benjamin R. Fuller
*Assistant Examiner*—C. Dickens
(74) *Attorney, Agent, or Firm*—McGuireWoods LLP

(57) ABSTRACT

An on-demand ink jet head includes a plurality of piezoelectric elements in alignment with one another with one end of each facing in the same direction. The end of each piezoelectric element is bonded by an adhesive material to a diaphragm which, together with a nozzle plate, forms a pressurizing chamber. To confine the fluid state adhesive material expelled out of the endmost piezoelectric elements, a dummy piezoelectric element is disposed outside each endmost piezoelectric element. The adhesive material, when dried, serves as a damper of the piezoelectric element for damping unwanted vibrations of the piezoelectric elements. By the provision of the dummy piezoelectric elements, the distribution of the adhesive material becomes substantially even between the piezoelectric elements, resulting in uniform operations of the piezoelectric elements.

11 Claims, 3 Drawing Sheets

MULTI-NOZZLE INK JET HEAD WITH DUMMY PIEZOELECTRIC ELEMENTS AT BOTH ENDS OF A PIEZOELECTRIC ELEMENT ARRAY FOR CONTROLLING THE FLOW OF ADHESIVE ABOUT THE PIEZOELECTRIC ELEMENT ARRAY

BACKGROUND OF THE INVENTION

1. Field of the Invention

The present invention relates to an on-demand ink jet head utilizing piezoelectric elements, and more particularly to such a head wherein a plurality of the nozzles are tightly arranged in confrontation with the piezoelectric elements.

2. Description of the Prior Art

An example of conventional ink jet head is illustrated in FIG. 1. As shown therein, piezoelectric elements 4 are in alignment with one another in a columnar direction orthogonal to a main scanning direction. The piezoelectric elements 4 have one end secured to a head substrate 6 and another end attached to a diaphragm 3 by an adhesive material 11. Pressurizing chambers 1 are formed in association with the piezoelectric elements 4, which chambers are defined by a nozzle plate 14 formed with nozzles 1 and a chamber plate 13. Ink is supplied from a common ink channel (not shown) into the pressurizing chambers 1 through individual ink channels defined by the restricting plate 12 and the diaphragm 3.

Referring again to FIG. 1, bonding of the piezoelectric elements 4 and the diaphragm 3 is performed in such a manner that the piezoelectric elements 4 with a predetermined amount of adhesive material 11 coated on the end surfaces thereof are pressed against the diaphragm 3. An excess amount of the adhesive material 11 is then expelled out of the space between the end surface of the piezoelectric element and the diaphragm 3. The flowed out adhesive material 11 is confined in a space between the adjacent two piezoelectric elements 4. Hence, when the adhesive material 11 is solidified, the intervened piezoelectric elements are supported by the solidified adhesive material layers of substantially the same shape. However, with respect to the two endmost piezoelectric elements, the solidified adhesive material layer in the outer side is different in shape from that in the inner side. The solidified adhesive material 11 has elasticity and serves as dampers of the piezoelectric elements 4.

When printing is performed with the ink jet head thus constructed, a secondary droplet is occasionally ejected following ejection of a primary droplet. The two droplets do not overlap when they impinge on a recording medium.

SUMMARY OF THE INVENTION

In order to improve the print quality, the present inventors investigated the reasons for the production of the secondary droplet and have found that the secondary droplets result from the distribution of the adhesive material 11 through extensive experiment. The inventors have also found through experimentation that all of the piezoelectric elements 4 of FIG. 1 need to be supported by the dampers of the same shape in order to attain uniform operability of the piezoelectric elements 4.

In view of the foregoing, an object of the present invention is to provide a multi-nozzle ink jet head using a plurality of piezoelectric elements in which uniform operation of those piezoelectric elements is ensured.

In order to achieve the above and other objects, the present invention provides a multi-nozzle ink jet head including a nozzle plate formed with a plurality of nozzles from which ink droplets are ejected; a diaphragm supported to be substantially in parallel with the nozzle plate; a chamber plate; a restricting plate; a plurality of piezoelectric elements; a plurality of input terminal pairs provided corresponding to respective ones of the plurality of piezoelectric elements individually; and two dummy elements, each disposed in a position outside each of two endmost piezoelectric elements of the plurality of piezoelectric elements. The piezoelectric elements and the two dummy elements are spaced at a substantially constant interval.

The chamber plate, the nozzle plate, and the diaphragm form a plurality of pressurizing chambers corresponding to respective ones of the plurality of nozzles individually. The restricting plate, the chamber plate, and the diaphragm form a plurality of ink channels connecting each of the plurality of pressurizing chambers with a common ink channel. The restricting plate is provided for controlling an inflow amount of ink into each of the pressurizing chambers from the common ink channel. The piezoelectric elements are provided corresponding to respective ones of the pressuring chambers individually. Those piezoelectric elements are in alignment with one another so that one end of each of the plurality of piezoelectric elements face the diaphragm. During assembly of the above-described components, an adhesive material is used for bonding one end of each piezoelectric element to the diaphragm. The adhesive material is in a fluid state at a time of bonding and in a solid state when dried. In the present invention, two dummy elements prevent the fluid state adhesive material from flowing out during assembly. When the adhesive material is dried, it has elasticity and serves as a damper of the piezoelectric element for damping unwanted vibrations of the piezoelectric elements. Such an adhesive material is made from a silicon resin, an acrylic resin, or a nitrile resin.

With the head thus constructed, when the input terminal pairs selectively apply a voltage to the corresponding piezoelectric elements to cause them to deform, for example, against the diaphragm, ink filled in the corresponding pressurizing chambers is pressurized and ink droplets are ejected from the corresponding nozzles. By the provision of the dummy elements, the distribution of the adhesive material serving as the damper is substantially even between the piezoelectric elements. Therefore, with the same voltage applied to the piezoelectric elements, ink droplets are ejected from the nozzles substantially at the same speed. Further, generation of a secondary droplet following a primary droplet can be prevented and thus print quality is improved.

Preferably, the two dummy elements are piezoelectric elements.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

Figure 2:
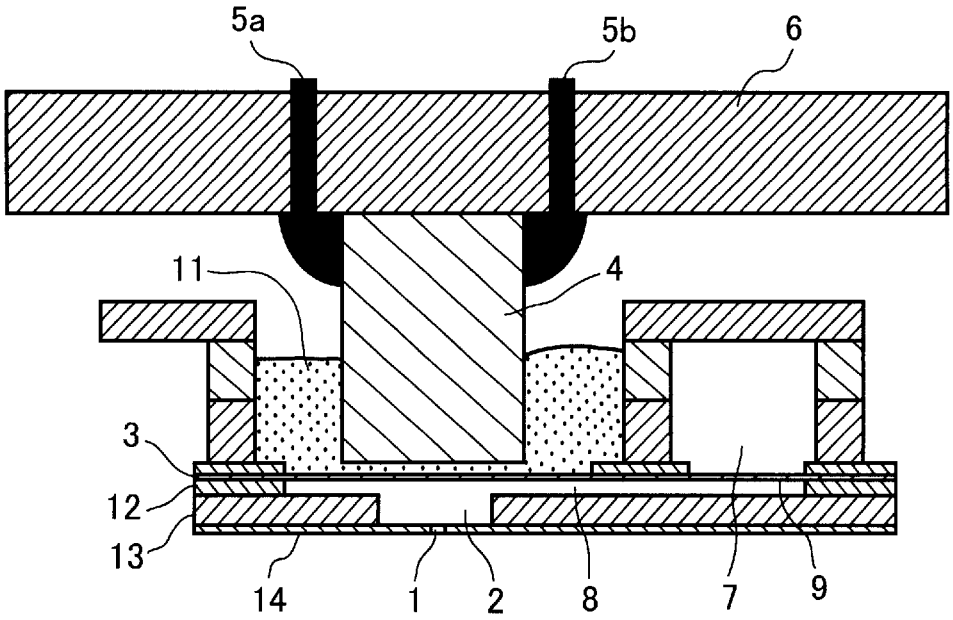
FIG. 2 is a cross-sectional view, cut along a line orthogonal to the columnar direction, showing an ink jet head according to the embodiment of the present invention.
Figure 3:
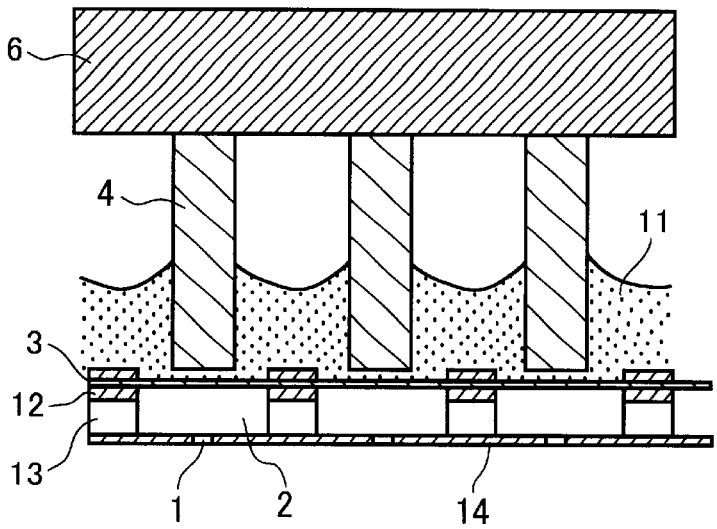
FIG. 3 is a cross-sectional view, cut along the line extending to the columnar direction, showing the center portion of the ink jet head shown in FIG. 2.

Referring to the drawings wherein like reference numerals refer to like parts throughout, reference will first be made to FIGS. 2 and 3 wherein there is shown a multi-nozzle ink jet head that includes a nozzle plate 14 formed with a plurality of nozzles 1; a diaphragm plate 3 formed with a plurality of diaphragms in one-to-one correspondence with the nozzles 1; a restricting plate 12; and a chamber plate 13. The latter two plates 12 and 13 are interposed between the nozzle plate 14 and the diaphragm plate 3. The diaphragm plate 3, restricting plate 12, and chamber plate 13 are, for example, made form stainless steel. The nozzle plate 14 is made from nickel. The diaphragm plate 3 has an uniform thickness, so the diaphragms formed therein are also uniform in thickness. The chamber plate 13, nozzle plate 14, and diaphragm form a plurality of pressurizing chambers 2 corresponding to respective ones of the plurality of nozzles 1 individually. The restricting plate 12, chamber plate 13, and diaphragm form a plurality of individual ink channels 8 connecting each of the plurality of pressurizing chambers 2 with a common ink channel 7. The restricting plate 12 is provided for controlling an inflow amount of ink into each pressurizing chamber 2 from the common ink channel 7. The pressurizing chambers 2 and the individual ink channels 8 are formed by the nozzle plate 1, chamber plate 13, restricting plate 12 and diaphragm plate 3 which are stacked one above the other in the stated order.

A plurality of piezoelectric elements 4 are provided corresponding to respective ones of the plurality of pressuring chambers 2 individually. Those piezoelectric elements 4 are in alignment with one another so that one end of each of the piezoelectric elements 4 face the diaphragm. Another end of each of the piezoelectric elements 4 is secured to a head substrate 6 made from an insulating material, such as ceramics. A plurality of input terminal pairs 5*a,* 5*b* are provided corresponding to respective ones of the plurality of piezoelectric elements 4 individually. The input terminals 5*a,* 5*b* apply a driving voltage to the piezoelectric element 4 to cause the latter to deform. The piezoelectric element 4 extends to the polarized direction when the driving voltage is applied thereto and restores to its initial length when application of the driving voltage is stopped. The piezoelectric element 4 as used in this embodiment is of $d_{33}$ type and a laminated structure to elongate in the polarized direction. Therefore, the piezoelectric element 4 extends to its longitudinal direction when the driving voltage is applied thereto. The diaphragm is held in a flat condition when no driving voltage is applied to the piezoelectric element 4, so the pressurizing chamber 2 has a natural or initial volume. In this embodiment, the piezoelectric elements 4 are held in an elongated condition during non-printing wherein the diaphragm is deformed inwardly of the pressurizing chamber 2. To eject an ink droplet, the driving voltage being applied to the piezoelectric element 4 is momentarily stopped to restore the piezoelectric element 4 and thereby introduce ink into the pressurizing chamber 2. At a timing when the ink pressure in the pressurizing chamber 2 is maximized, the piezoelectric element 4 is triggered by applying the driving voltage thereto. Then, the ink filled in the pressurizing chamber 2 is pressurized and ink is ejected from the nozzle 1.

Figure 4:
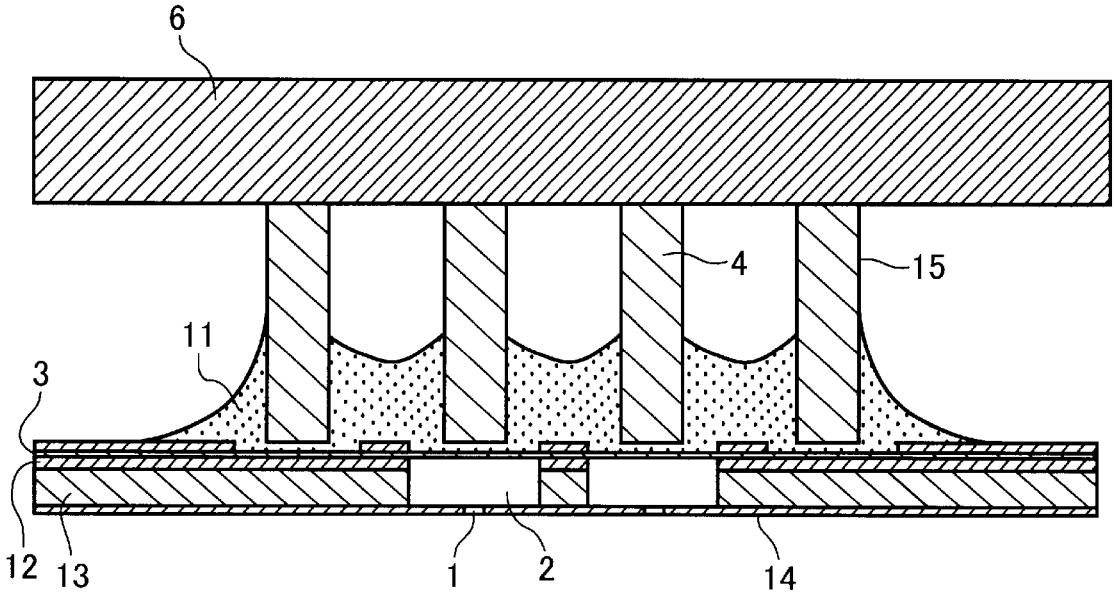
FIG. 4 is a cross-sectional view, cut along the line extending to the columnar direction, showing the end portion of the ink jet head shown in FIG. 2.

As shown in FIG. 4, a dummy piezoelectric element 15 is disposed in a position outside one endmost piezoelectric element 4. Likewise, another dummy piezoelectric element 15 is disposed outside another endmost piezoelectric element 4. The piezoelectric elements 4 and the dummy piezoelectric elements 15 are in alignment with one another and spaced apart at an equal interval. No input terminals are attached to the dummy piezoelectric elements 15 unlike the piezoelectric elements 4.

One end of each of the piezoelectric elements 4 and the dummy piezoelectric elements 15 is bonded to the diaphragm by an adhesive material 11. The adhesive material 11 is in a fluid state at a time of binding and in a solid state when dried. The adhesive material 11 has elasticity in the solid state and serves as dampers for damping unwanted vibrations of the piezoelectric elements 4. A silicon resin, an acrylic resin or a nitrile resin is used as the adhesive material 11.

The two dummy piezoelectric elements 15 are provided for confining the fluid state adhesive material 11 expelled outwardly of the endmost piezoelectric element 4. In bonding the piezoelectric elements 4 and the dummy piezoelectric elements 15 to the diaphragm 3, a predetermined amount of the fluid state adhesive material 11 is uniformly coated on the end surfaces of the piezoelectric elements 4 and the dummy piezoelectric elements 15. Then, those elements 4 and 15 are pressed against the diaphragm 3. An extra amount of the adhesive material 11 is expelled out of the space between the end surfaces of the piezoelectric elements 4 and 15 and the diaphragm 3. When the adhesive material 11 is dried and solidified, the piezoelectric elements 4 and 15 and the diaphragm 3 are bonded together. Typically, the adhesive material 11 interposed between the end surfaces of the piezoelectric elements 4 and 15 and the diaphragm 3 has a thickness in a range from 5 to 20 microns when the adhesive material 11 is solidified. Also, solidified adhesive material layers are formed in a space between two adjacent elements. As shown in FIG. 4, due to the provision of the dummy piezoelectric element 15 in a position outside each of the two endmost piezoelectric elements 4, about a half amount of the adhesive material 11 expelled by the endmost piezoelectric element 4 and about a half amount of the adhesive material 11 expelled by the adjacent dummy piezoelectric element 15 join together at a space between these two piezoelectric elements 4 and 15. As a result, all of the piezoelectric elements 4 including the two endmost ones are supported under the same condition by the solidified adhesive material layers serving as dampers. Hence, uniform operations of the piezoelectric elements 4 can be achieved wherein substantially the same amount of ink is ejected from the respective nozzles 1 by applying substantially the same driving voltage to the respective piezoelectric elements 4. Also, the piezoelectric elements 4 exhibit substantially the same attenuation characteristic when oscillated.

Figure 1:
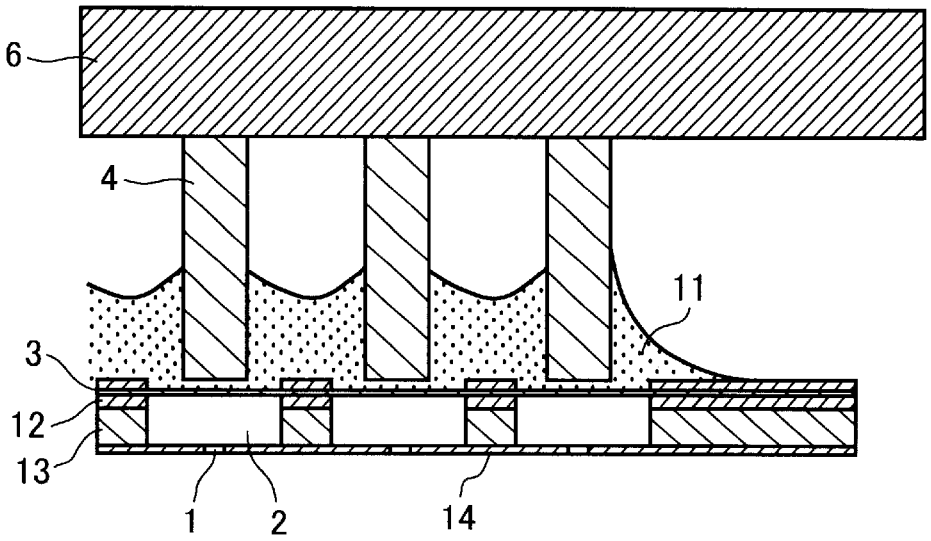
FIG.1 PRIOR ART
FIG. 1 is a cross-sectional view, cut along a line extending to a columnar direction, showing a conventional ink jet head.
Figure 5:
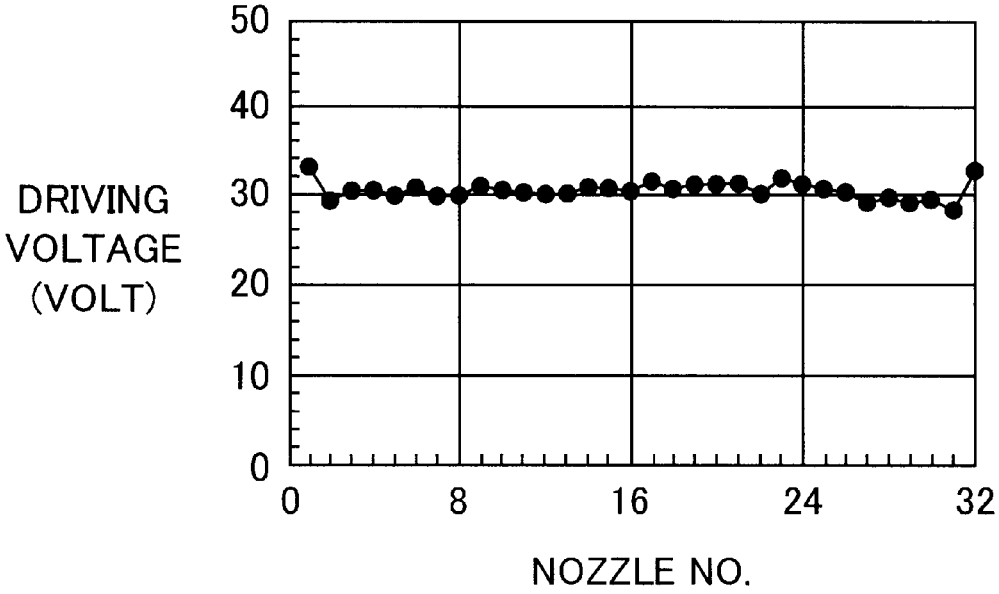
FIG.5 PRIOR ART
FIG. 5 is a diagram showing a driving voltage distribution of the ink jet head shown in FIG. 1.
Figure 6:
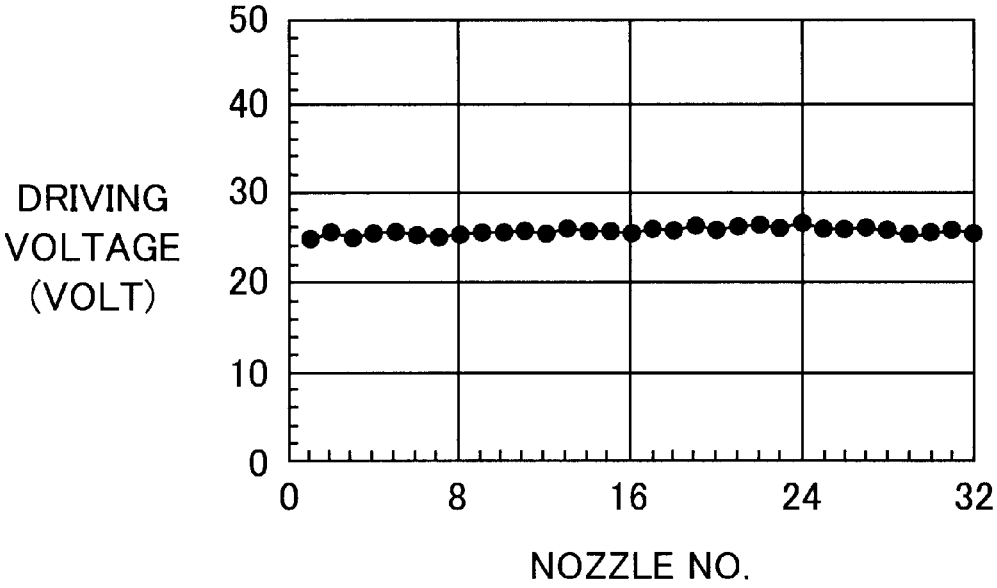
FIG. 6 is a diagram showing a driving voltage distribution of the ink jet head according to the present invention.

FIGS. 5 and 6 show the results of comparative tests performed with respect to the conventional head depicted in FIG. 1 and also to the head according to the embodiment in FIG. 4. Each head has 32 nozzles. The diagrams in FIGS. 5 and 6 indicate driving voltages that eject ink droplets at the speed of 13 m/sec. As can be appreciated from the diagrams, the piezoelectric elements 4 in the head of FIG. 4 can actuate uniformly by applying substantially the same driving voltage to all of the piezoelectric elements 4. On the other hand, the conventional head of FIG. 1 requires a higher driving voltage to actuate the two endmost piezoelectric elements than the driving voltage applied to the intervened piezoelectric elements in order to achieve the same result.

As described, according to the present invention, all of the piezoelectric element can be actuated by substantially the same driving voltage, so that level adjustment of the driving voltage to be applied to the respective piezoelectric elements can be dispensed with, thus the cost of the power source is reduced.

While only one exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

For example, although the foregoing embodiment described providing the dummy piezoelectric elements, they may not be the piezoelectric elements but be made from other materials. In addition, the shape of the dummy (piezoelectric) elements may not be exactly the same as that of the piezoelectric elements used for ejecting ink droplets. Any shape of the dummy elements is acceptable insofar as they can confine the fluid state adhesive material and distribution of the adhesive material can become substantially even with respect to all of the piezoelectric elements 4.

The above-described embodiment describes the use of $d_{33}$ type piezoelectric element, however, the use of $d_{31}$ type piezoelectric element is also possible. Further, ejection of the ink droplet may be performed precedent to suction of ink into the pressurizing chamber. In this case, the pressurizing chamber is being held in the initial volume during non-printing, and when the inwardly deformed diaphragm restores to the initial condition, the ink is supplemented through the common ink channel 7 and the individual ink channel 8.

What is claimed is:

1. A multi-nozzle ink jet head comprising:

a nozzle plate formed with a plurality of nozzles from which ink droplets are ejected;

a diaphragm supported to be substantially in parallel with said nozzle plate;

a chamber plate, said chamber plate, said nozzle plate, and said diaphragm forming a plurality of pressurizing chambers corresponding to respective ones of the plurality of nozzles individually;

a restricting plate, said restricting plate, said chamber plate, and said diaphragm forming a plurality of ink channels connecting each of the plurality of pressurizing chambers with a common ink channel, said restricting plate controlling an inflow amount of ink into each of the plurality of pressurizing chambers from the common ink channel;

a plurality of piezoelectric elements provided corresponding to respective ones of the plurality of pressurizing chambers individually, said plurality of piezoelectric elements being in alignment with one another so that one end of each of said plurality of piezoelectric elements face said diaphragm, the plurality of piezoelectric elements including two endmost piezoelectric elements;

an adhesive material that bonds the one end of the each of said plurality of piezoelectric elements and said diaphragm, said adhesive material being in a fluid state at a time of bonding and in a solid state when dried;

a plurality of input terminal pairs provided corresponding to respective ones of said plurality of piezoelectric elements individually, each of said plurality of input terminal pairs applying a voltage to a corresponding piezoelectric element to cause the corresponding piezoelectric element to deform, thereby pressurizing ink filled in a corresponding pressurizing chamber and ejecting an ink droplet from a corresponding nozzle;

two non-driven dummy elements in alignment with said plurality of piezoelectric elements, each of the two non-driven dummy elements being positioned outside each of the two endmost piezoelectric elements and bonded to the diaphragm at one end via the adhesive material, said two non-driven dummy elements blocking flow out of the fluid state adhesive material, the two non-driven dummy elements being inactive for a driving voltage to pass therethrough.

2. The multi-nozzle ink jet head according to claim 1, wherein said two non-driven dummy elements are piezoelectric elements.

3. The multi-nozzle ink jet head according to claim 2, wherein said plurality of piezoelectric elements and said two non-driven dummy elements are spaced at a substantially constant interval.

4. The multi-nozzle ink jet head according to claim 1, wherein said adhesive material has elasticity in the solid state and damping unwanted vibrations of said plurality of piezoelectric elements.

5. The multi-nozzle ink jet head according to claim 1, wherein said adhesive material is made from a silicon resin.

6. The multi-nozzle ink jet head according to claim 1, wherein said adhesive material is made from an acrylic resin.

7. The multi-nozzle ink jet head according to claim 1, wherein said adhesive material is made from a nitrile resin.

8. The multi-nozzle ink jet head according to claim 1, wherein the solid state adhesive material interposed between the end face of each of said plurality of piezoelectric elements and said diaphragm has a thickness in a range from 5 to 20 microns.

9. The multi-nozzle ink jet head according to claim 1, wherein the solid state adhesive material interposed between the end face of each of said plurality of piezoelectric elements and said diaphragm acts as a damper.

10. The multi-nozzle ink jet head according to claim 1, wherein the evenly interposed solid state adhesive material prevents secondary droplets from ejecting from the nozzles after the ink droplets are ejected.

11. The multi-nozzle ink jet head according to claim 1, further comprising a head substrate, the plurality of piezoelectric elements and the two non-driven dummy elements connecting to the head substrate at an end opposing the diaphragm.

* * * * *